US010752416B2

(12) United States Patent
Goto et al.

(10) Patent No.: US 10,752,416 B2
(45) Date of Patent: Aug. 25, 2020

(54) PACKING MEMBER AND PACKING METHOD

(71) Applicant: CANON KABUSHIKI KAISHA, Tokyo (JP)

(72) Inventors: Atsushi Goto, Moriya (JP); Satoshi Kumamoto, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 143 days.

(21) Appl. No.: 15/570,423

(22) PCT Filed: Jul. 14, 2016

(86) PCT No.: PCT/JP2016/071465

§ 371 (c)(1),
(2) Date: Oct. 30, 2017

(87) PCT Pub. No.: WO2017/010577

PCT Pub. Date: Jan. 19, 2017

(65) Prior Publication Data

US 2018/0354694 A1 Dec. 13, 2018

(30) Foreign Application Priority Data

Jul. 14, 2015 (JP) ..... 2015-140584

(51) Int. Cl.
*B65D 75/00* (2006.01)
*B65B 53/02* (2006.01)
(Continued)

(52) U.S. Cl.
CPC ..... *B65D 75/004* (2013.01); *B65B 9/026* (2013.01); *B65B 11/50* (2013.01); *B65B 41/16* (2013.01);
(Continued)

(58) Field of Classification Search
CPC .... B65D 75/004; B65D 77/003; B65B 61/06; B65B 41/16; B65B 11/50; B65B 9/026; B65B 53/02; G03G 21/181
(Continued)

(56) References Cited

U.S. PATENT DOCUMENTS 3,338,404 A * 8/1967 Becker ..... B65D 71/10 206/139
3,353,326 A * 11/1967 Becker ..... B65B 21/245 206/162
(Continued)

FOREIGN PATENT DOCUMENTS

CN 101754908 A 6/2010
EP 0178142 A1 4/1986
(Continued)

OTHER PUBLICATIONS

Japanese Office Action issued in corresponding Japanese Application No. 2015-140584 dated Jan. 29, 2019.
(Continued)

*Primary Examiner* — Ernesto A Grano
(74) *Attorney, Agent, or Firm* — Venable LLP

(57) ABSTRACT

A packing member includes a structure for accommodating an object-to-be-accommodated and a cylindrical sheet for covering the structure. The cylindrical sheet includes a first portion having a heat contraction property and includes a second portion having an elasticity higher than that of the first portion. The first portion has a display portion. The display portion is provided on a surface extending along a predetermined direction of the structure. Free end portions of the first portion and the second portion contract to surround an end surface of the structure crossing the predetermined direction of the structure.

20 Claims, 6 Drawing Sheets

(51) Int. Cl.

| | |
|---|---|
| ***B65B 9/02*** | (2006.01) |
| ***B65D 77/00*** | (2006.01) |
| ***B65B 11/50*** | (2006.01) |
| ***B65B 41/16*** | (2006.01) |
| ***B65B 61/06*** | (2006.01) |
| ***G03G 21/18*** | (2006.01) |

(52) U.S. Cl.
CPC ..... *B65B 53/02* (2013.01); *B65B 61/06* (2013.01); *B65D 75/002* (2013.01); *B65D 77/003* (2013.01); *G03G 21/181* (2013.01)

(58) Field of Classification Search
USPC ..... 206/459.5
See application file for complete search history.

(56) References Cited

U.S. PATENT DOCUMENTS

| | | | | | |
|---|---|---|---|---|---|
| 3,525,428 | A | | 8/1970 | Stephan | |
| 3,557,516 | A | * | 1/1971 | Brandt | B65B 61/14 206/428 |
| 3,566,752 | A | * | 3/1971 | Dreher | B31B 50/00 156/260 |
| 3,585,777 | A | | 6/1971 | Pesch | |
| 3,756,395 | A | * | 9/1973 | Ganz | B65D 71/10 206/161 |
| 3,756,397 | A | | 9/1973 | Ganz | |
| 3,834,525 | A | | 9/1974 | Morgese et al. | |
| 3,892,057 | A | | 7/1975 | Goode | |
| 3,978,874 | A | * | 9/1976 | Schmidt, Sr. | B65B 53/04 134/107 |
| 4,207,221 | A | * | 6/1980 | Tobias | C08L 23/02 523/124 |
| 4,289,236 | A | * | 9/1981 | Ganz | B65B 53/02 206/432 |
| 4,296,861 | A | * | 10/1981 | Barrash | B65D 71/02 206/428 |
| 4,304,332 | A | * | 12/1981 | Danti | B65D 71/10 206/427 |
| 4,403,463 | A | * | 9/1983 | Danti | B65B 53/00 53/134.1 |
| 4,475,653 | A | * | 10/1984 | Ullman | B65B 53/02 206/432 |
| 4,641,488 | A | | 2/1987 | Garr | |
| 4,700,528 | A | * | 10/1987 | Bernard | B65B 53/02 206/432 |
| 5,771,662 | A | * | 6/1998 | Struges | B65B 61/02 53/399 |
| 6,826,890 | B2 | * | 12/2004 | Mauro | B65B 11/585 53/134.1 |
| 6,880,313 | B1 | * | 4/2005 | Gessford | B65B 9/026 53/415 |
| 6,942,325 | B2 | | 9/2005 | Nanjo | |
| 7,032,360 | B2 | * | 4/2006 | Rutten | B26F 3/002 53/399 |
| 7,237,671 | B2 | * | 7/2007 | Chambers | B65D 21/0205 206/150 |
| 7,992,715 | B2 | | 8/2011 | Kwon | |
| 8,267,248 | B2 | | 9/2012 | Kollmuss | |
| 8,333,054 | B2 | * | 12/2012 | Hartl | B65D 71/08 206/432 |
| 8,424,272 | B2 | * | 4/2013 | Cerf | B65B 21/245 206/428 |
| 9,708,085 | B2 | * | 7/2017 | Moore | B65B 13/02 |
| 2002/0157350 | A1 | | 10/2002 | Dickey et al. | |
| 2008/0292225 | A1 | | 11/2008 | Dayrit et al. | |

FOREIGN PATENT DOCUMENTS

| | | | |
|---|---|---|---|
| EP | 2233405 | A1 | 9/2010 |
| FR | 2524422 | A1 | 10/1983 |
| GB | 1062348 | A | 3/1967 |
| JP | S58-116504 | U | 8/1983 |
| JP | S63-272680 | A | 11/1988 |
| JP | H07-187114 | A | 7/1995 |
| JP | H11-1211 | A | 1/1999 |
| JP | 2002-087460 | A | 3/2002 |
| JP | 2002-225924 | A | 8/2002 |
| JP | 2002-332016 | A | 11/2002 |
| JP | 2003-267438 | A | 9/2003 |
| JP | 2005112466 | A | 4/2005 |
| JP | 2008049506 | A | 3/2008 |
| JP | 2008-260556 | A | 10/2008 |
| JP | 2009-069823 | A | 4/2009 |
| JP | 3164354 | U | 11/2010 |
| JP | 2017-165472 | A | 9/2017 |
| WO | 2008/090362 | A1 | 7/2008 |

OTHER PUBLICATIONS

International Search Report and Written Opinion of International Application No. PCT/JP2016/071465 dated Feb. 17, 2017.
European Office Action issued in corresponding European Application No. 16763335.3 dated Nov. 28, 2018.
Russian Decision to Grant a Patent dated Dec. 10, 2018, in Russian Application No. 2018105264/12(008059).
Office Action dated Dec. 27, 2018, in Korean Application No. 9-5-2018-089112297.
Chinese Office Action issued in corresponding Chinese Application No. 201680031234.X dated Mar. 5, 2019.
Japanese Office Action issued in corresponding Japanese Application No. 2015-140584 dated Aug. 20, 2019.
Japanese Office Action, dated Mar. 3, 2020, in corresponding Japanese Application No. 2015-140584.
Indian Office Action, dated Apr. 27, 2020, in Indian Patent Application No. 201747076210.
Brazilian Search Report, dated Apr. 20, 2020, in Brazilian Application No. BR112017022510-7.
Chinese Office Action, dated May 21, 2020, in corresponding Chinese Application No. 201910601220.2.

* cited by examiner (a)

(b)

(a)

(b)

PACKING MEMBER AND PACKING METHOD

TECHNICAL FIELD

The present invention relates to a packing member and a packing method.

BACKGROUND ART

As a packing method of a cartridge for use with an image forming apparatus, various packing methods have been proposed. For example, a method in which a cushioning member is mounted at each of end portions of the cartridge with respect to an axial direction of a developing roller, and the cartridge is accommodated in a box having a hexahedral trapezoidal shape having side surfaces each having an isosceles trapezoidal shape has been known (Japanese Laid-Open Patent Application (JP-A) 2008-260556).

In addition, also a method in which a cartridge is provided between an upper supporting member and a lower supporting member and is accommodated in a box and then is packed has been known (JP-A 2009-69823).

On the other hand, a method in which a member-to-be-packed is subjected to shrink packing with, as a packing material, a heat-shrinkable film having a printed layer has been disclosed (JP-A 2002-87460).

In the cartridge for use with the image forming apparatus, there is a need to display many pieces of information such as a manufacturer and the kind of corresponding device (model). As regards product information of the cartridge, the information achieves commonalty of the many pieces of information such as the manufacturer and the kind of corresponding device but has a difference in only pieces of information such as a color and a toner capacity in some cases. Conventionally, the product information was printed together with printing of package design on a structure such as a box, specifically a corrugated cardboard which forms the box. For this reason, even in the case where the commonality of the many pieces of information is provided, boxes were required to be individually prepared in advance, so that a large space was required as a storage space for packing materials.

Therefore, it would be considered that a constitution in which commonality of structures such as boxes is provided and, depending on a cartridge which is an object-to-be-accommodated, shrink packing is effected using a heat-shrinkable film (sheet) on which the product information is displayed is employed and thus the storage space for packing materials is reduced. However, in the case where the shrink packing was effected using the sheet on which the product information was displayed, a display portion with information such as a character, a code or a graphic (figure) lost its shape and thus it was difficult to read the displayed information in some cases.

SUMMARY OF THE INVENTION

According to an aspect of the present invention, there is provided a packing member comprising: a structure for accommodating an object to be accommodated; and a cylindrical sheet for covering said structure, wherein said cylindrical sheet includes a first portion having a heat contraction property and includes a second portion having an elasticity higher than that of said first portion, said first portion having a display portion, wherein said display portion is provided on a surface extending along a predetermined direction of said structure, and wherein free end portions of said first portion and said second portion contract (shrink) to surround an end surface of said structure crossing the predetermined direction of said structure.

According to another aspect of the present invention, there is provided packing method of a packing member including a structure for accommodating an object to be accommodated and a cylindrical sheet for covering said structure, wherein the cylindrical sheet includes a first portion having a heat contraction property and includes a second portion having an elasticity higher than that of the first portion, said packing method comprising: a first step of bonding the first sheet and the second sheet to each other; a second step of forming the cylindrical sheet by wrapping the first sheet and the second sheet so that the display portion is positioned on a surface extending along a first direction of the structure and then by bonding the first sheet and the second sheet in a state in which tension is caused to act on the second sheet; and a third step of contracting free end portions of the first sheet and the second sheet so as to surround an end surface crossing the first direction of the structure.

According to a further aspect of the present invention, there is provided a packing method of a packing member comprising a structure for accommodating an object-to-be-accommodated and a cylindrical sheet covering a surface extending along a first direction of the structure, including a display portion and partly having a heat contraction property, the packing method comprising: a first step of providing the structure in the cylindrical sheet so that the display portion is positioned on a surface extending along the first direction; and a second step of contracting the cylindrical sheet by heating means so as to surround an end surface of the structure while supporting a portion, extending in the first direction from a portion contacting a bottom of the structure positioned at a lower portion with respect to a vertical direction, upwardly by a supporting member with respect to the vertical direction.

Further features of the present invention will become apparent from the following description of exemplary embodiments with reference to the attached drawings.

DESCRIPTION OF EMBODIMENTS

Embodiment 1

<Packing Member>

Figure 1:
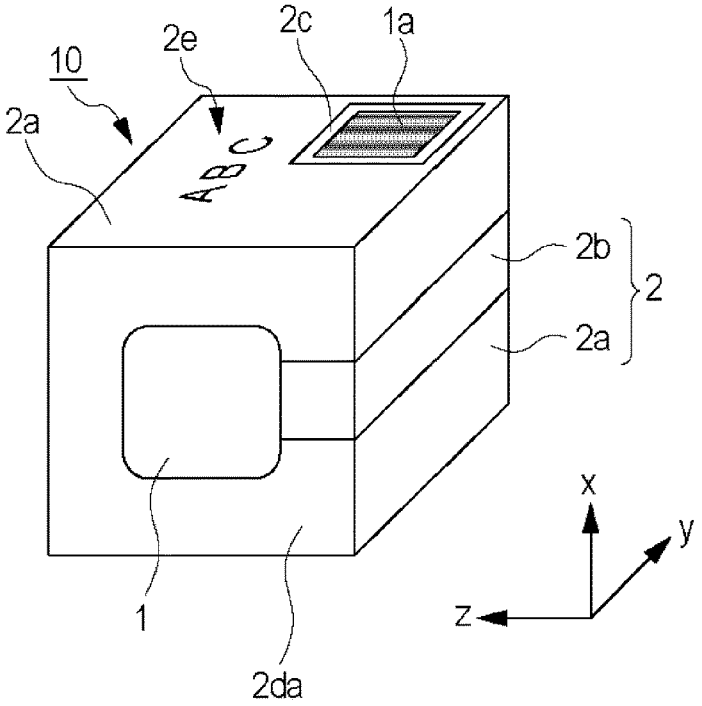
FIG. 1 is a perspective view showing a packing member 10 for a cartridge P in Embodiment 1 of the present invention.
Figure 2:
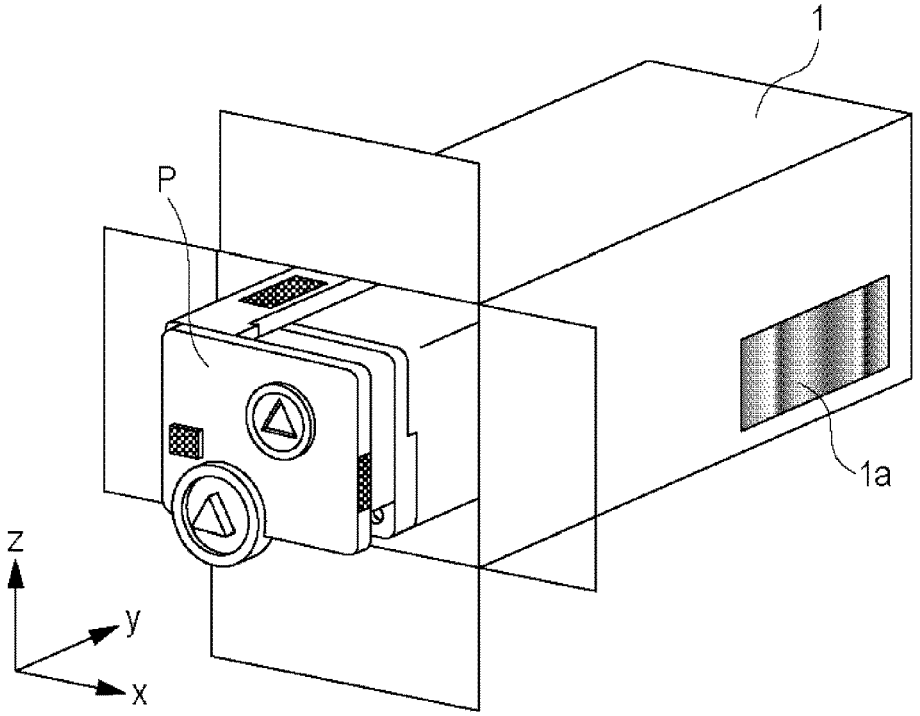
FIG. 2 is a perspective view showing a box 1 for accommodating the cartridge P in Embodiment 1.

A packing member 10 for a cartridge P in this embodiment will be described with reference to FIGS. 1 and 2. FIG. 1 is a perspective view showing the packing member 10 for the cartridge P in this embodiment. FIG. 2 is a perspective view for illustrating a packing state of the cartridge P in this embodiment. In the following, as regards the cartridge P which is a member-to-be-packed and the packing member 10, one widthwise direction is x direction, one longitudinal direction (first direction) is y direction and an upward direction is z direction, and description of the cartridge P and the packing member 10 will be made.

In the following, the cartridge P which is the member-to-be-packed is a drum cartridge for supporting an electrophotographic photosensitive drum, a developing cartridge for supporting a developing means, a process cartridge prepared by integrally assembling the electrophotographic photosensitive drum and a process means into a cartridge (unit), or the like cartridge. The process means acts on the electrophotographic photosensitive drum, and examples thereof include not only a charging means, the developing means, a cleaning means and the like which act on the electrophotographic photosensitive drum, but also an application roller for applying a toner onto a toner carrying member, a remaining toner amount detecting means, and the like. Here, the electrophotographic photosensitive drum and the process means correspond to parts (components) for forming an image by an electrophotographic process.

As shown in FIG. 1, the packing member 10 for the cartridge P in this embodiment includes a box 1 and a sheet member 2. Further, as shown in FIG. 2, the box 1 accommodates the cartridge P together with a cushioning member (not shown) for alleviating an impact (shock) transmitted to the cartridge P. The box 1 is a packing container for accommodating an object-to-be-accommodated and is a structure for defining an outer configuration (shape) of the packing member 10. Therefore, in this embodiment, the box 1 was formed in a hexahedral shape so that a plurality of packing members 10 were able to be conveniently mounted during transportation. Further, on an outer surface of the box 1, a character, a second display portion 1*a* for displaying information, such as a color or a toner capacity, depending on the cartridge P is provided on an end surface with respect to one widthwise direction (x direction) by printing a symbol (mark), a graphic (figure), a code or the like. As the cushioning member for absorbing the impact, it is possible to use a cushioning member formed with paper, plastic, rubber, foamed rubber, or the like.

To the box 1 in which the cartridge P is accommodated, the sheet member 2 formed as a ring member (cylindrical sheet) so as to cover and tighten both side surfaces with respect to the widthwise direction and upper and lower surfaces is fixed. The sheet member 2 includes a first sheet (first portion) 2*a* on which information in displayed and which has a heat contraction property and a second sheet (second portion) 2*b* having an elasticity higher than that of the first sheet 2*a*. The elasticity specifically refers to elastic modulus in tension, and the elastic modulus in tension can be calculated from a tensile test in which an elongation amount and a displacement data of a test piece is measured using an extensometer.

The first sheet 2*a* is provided with a display portion 2*e* for displaying information such as a manufacturer or the kind of corresponding device (model), common to a plurality of cartridges by printing not only a character such as "ABC" as shown in FIG. 1 but also a graphic, a symbol, a code or the like at the first display portion 2*e*. In addition, the first sheet 2*a* is provided with a transparent portion 2*c* through which the second display portion 2*a* provided on the box 1 is visible. As the first sheet 2*a*, it is possible to use a sheet which is formed of polyethylene, polyvinyl chloride, polypropylene, polystyrene, polyolefin, polyethylene terephthalate or the like by a drawing process or the like and which has a heat contraction property. Further, as the second sheet 2*b*, it is possible to use a sheet which has an elasticity higher than that of the first sheet 2*a*, i.e., which easily elongates. For example, the first sheet 2*a* and the second sheet 2*b* are thermally welded to each other, and therefore, the second sheet 2*b* can be formed of the same material as the first sheet 2*a* and has a lower density or a smaller thickness than that of the first sheet 2*a*, and may also be formed by a process other than the drawing process. Incidentally, in the case where the first sheet 2*a* and the second sheet 2*b* are formed of different materials, the first sheet 2*a* and the second sheet 2*b* may also be bonded to each other through an adhesive. Thus, a bonding method is not limited to the welding.

The sheet member 2 is constituted so that both ends of the first sheet 2*a* with respect to a circumferential direction are pulled by elasticity of the second sheet 2*b* by connecting one end of the first sheet 2*a* with one end of the second sheet 2*b* and by connecting the other end of the first sheet 2*a* with the other end of the second sheet 2*b*. As a result, the cartridge P is tightened by inner peripheral surfaces of the first sheet 2*a* and the second sheet 2*b*. In this embodiment, with respect to the circumferential direction of the sheet member 2, the second sheet 2*b* covered a part of the lower surface of the box 1, and the first sheet 2*a* covered other portions such as the both side surfaces of the box 1 with respect to the widthwise direction and the upper surface of the box 1. Specifically, the first sheet 2*a* was disposed so that not only the first display portion 2*e* thereof was positioned on the end surface with respect to one widthwise direction of the box 1, i.e., on the surface extending along a longitudinal direction but also the second display portion 1*a* of the box 1 was visible through the transparent portion 2*c*.

Further, at each of both ends of the sheet member 2 with respect to the longitudinal direction, the sheet member 2 is provided with a first contracted portion 2*da*. The first contracted portion 2*d* is formed by contraction of the first sheet 2*a*. As a result, a peripheral length of a free end portion of the sheet member 2 is shorter than a peripheral length of the sheet member 2 at other portions crossing the longitudinal direction. Thus, the sheet member 2 includes the contracted portion 2*d* contracted at each of both ends thereof with respect to the longitudinal direction, but at other portions, the sheet member 2 is not substantially contracted.

Effect

In this embodiment, a constitution in which the second sheet 2*b* having an elasticity higher than that of the first sheet 2*a* was used and both ends of the first sheet 2*a* with respect to the circumferential direction were pulled by the elasticity of the second sheet 2*b* was employed. As a result, proper tension is applied to the sheet member 2 which is the ring member, so that the sheet member 2 can be fixed to the box 1. In addition, by using the second sheet 2*b* having the elasticity, it is possible to suppress elongation and contraction of the first sheet 2*a*. As a result, it is possible to suppress disablement of reading of the information due to loss of the shape of the character, the graphic, the symbol, the code or the like at the first display portion 2*e* displayed on the first sheet 2*a*. Further, as in this embodiment, in the case where the sheet member 2 is provided with the transparent portion 2*c*, the second sheet 2*a* including the transparent portion 2*c* is not contracted, and therefore it is possible to suppress positional deviation of the transparent portion 2*c* from the second display portion 1*a* provided on the box 1 and is preferable.

Further, in this embodiment, the sheet member 2 was provided with the contracted portions 2*d* at the longitudinal ends thereof. As a result, the peripheral length of the free end portions of the contracted portions 2*d* can be made shorter than the peripheral length of the sheet member 2. That is, at longitudinal end surfaces of the box 1, the contracted portions 2*d* can be formed as a part of the sheet member 2 so as to surround side surfaces of the box 1 extending along a direction crossing the longitudinal direction, so that it is possible to suppress disconnection of the box 1 from the sheet member 2.

Conventionally, in shrink packing in which a member-to-be-packed (box) was disposed in a sheet which is a ring member and the sheet was contracted in an entire region thereof and was closely contacted to the member (material)-to-be-packed, it was difficult to suppress the loss of the shape of the character, the graphic, the symbol, the code or the like displayed on the sheet and a positional deviation between the sheet and the member-to-be-packed. In this regard, in this embodiment, the constitution in which the sheet member 2 includes the contracted portions 2*d* contracted at both ends thereof with respect to the longitudinal direction, but at other portions, the sheet member 2 is not substantially contracted is employed. For this reason, it is possible to suppress the loss of the shape of the character, the graphic, the symbol, the code or the like displayed on the first sheet 2*a* at the first display portion 2*e* and the positional deviation between the second display portion 1*a* of the member-to-be-packed (box 1) and the transparent portion 2*c* of the first sheet 2*a*. On the other hand, similarly as in the shrink packing, the sheet member 2 is provided with the contracted portions 2*d* at its longitudinal ends, so that it is possible to suppress disconnection of the box 1 from the sheet member 2. Thus, it is possible to firmly wrap (pack) the member-to-be-packed with the sheet member while improving a design property of the packing member 10.

In addition, in this embodiment, the second display portion 1*a* for displaying the information such as the color or the toner capacity depending on the cartridge was provided on the box 1, and the first display portion 2*e* for displaying the information such as the manufacturer or the kind of corresponding device (model) common to the plurality of cartridges was provided on the first sheet 2*a*. A portion where the design property as a product package is further required can be formed as the first display portion 2*e* of the first sheet 2*a* is advance, while the box 1 is covered with the first sheet 2*a*, and therefore, the outer surface of the box 1 is not required to be subjected to a surface protecting process. For this reason, the second display portion 1*a* for displaying only the information depending on the cartridge can be formed on the common box 1 by an easy forming method depending on the cartridge before the packing of the cartridge. As a result, even in the case where the packing member depending on the plurality of members-to-be-packed is formed, the common sheet and the common box can be used, so that a storage space for the packing materials can be reduced.

Modified Embodiment 1

Figure 3:
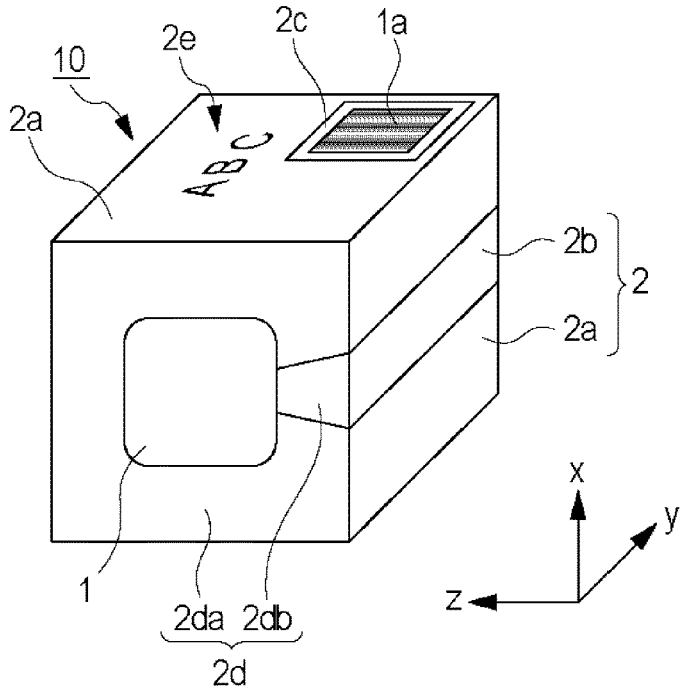
In FIG. 3, (a) and (b) are perspective views each showing a packing member 10 for a cartridge in Modified Embodiment 1 of the present invention.
Figure 3:
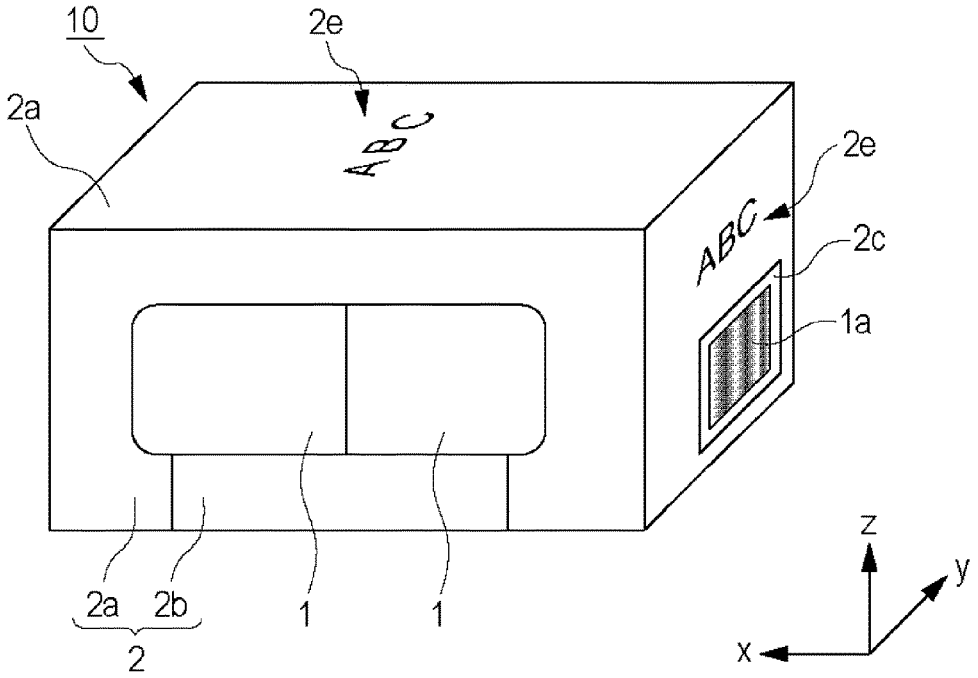

In the above-described embodiments, as the second sheet 2*b*, the sheet having an elasticity higher than that of the first sheet 2*a* was used. However, the second sheet 2*b* may also have not only an elasticity higher than that of the first sheet 2*a* but also a heat contraction property similarly as in the first sheet 2*a*. In this case, the second sheet 2*b* can be a sheet which is formed of the same material as the material of the first sheet 2*a* by the drawing process or the like in order to weld the second sheet 2*b* to the first sheet 2*a* and which has a lower density and a smaller thickness than those of the first sheet 2*a* in order to cause the first sheet 2*a* to have an elasticity higher than that of the first sheet 2*a*. By using the second sheet 2*b* having the elasticity and the heat contraction property, at both ends of the second sheet 2*b* with respect to the longitudinal direction, in addition to a first contracted portion 2*da* of the first sheet 2*a*, it is possible to form a second contracted portion 2*db* of the second sheet 2*b* ((a) of FIG. 3). As a result, at longitudinal end surfaces of the box 1, the sheet member 2 can be finely contracted so as to surround the side surfaces of the box 1.

Further, in the above-described embodiments, the constitution in which the second display portion 1*a* of the box 1 on which the information such as the color or the toner capacity indicated by the character, the graphic, the symbol, the code or the like was visible through the transparent portion 2*c* of the first sheet 2*a* was employed. However, a part of the structure such as the member-to-be-packed or the box, e.g., an uneven portion (projection and recess) of the structure may also be made visible through the transparent portion 2*c* of the first sheet 2*a*, and thus the second display portion 1*a* is not limited to a display portion where the information such as the color or the toner capacity indicated by the character, the graphic, the symbol, the code or the like is printed.

In addition, in the above-described embodiment, the constitution in which the single box 1 was wrapped (packed) with the sheet member 2 was employed, but the present invention is not limited thereto. For example, as shown in (b) of FIG. 3, a constitution in which a plurality of boxes 1 are integrally wrapped with the sheet member 2 may also be employed.

<Packing Method (Manufacturing Method) of Packing Member>

A packing method of the member-to-be-packed in Embodiment 1 will be described.

First of all, a packing step S1 of the cartridge P which is the member-to-be-packed is performed. A structure which is a packing container for accommodating the cartridge P and a cushioning member (material) for protecting the cartridge P from impact (shock) are prepared. As the structure, the box 1 is used, and the product information or the like is printed at the second display portion 1*a* on a side surface which is an end surface with respect to one widthwise direction (x direction). The cartridge P is fixed inside the box 1 through the cushioning member so as to prevent positional deviation of the cartridge P, so that the box 1 in which the cartridge P is accommodated is formed (FIG. 2).

The box 1 in which the cartridge P is accommodated is subjected to a wrapping (packing) step S2 of wrapping the box 1 with a cylindrical sheet at a periphery of the box 1 by a sheet wrapping and fastening device 20. The sheet wrapping and fastening device 20 includes a fusion-cutting mechanism 14 for cutting and welding a first sheet material T1 which forms the first sheet 2*a* and a second sheet material T2 which forms the second sheet 2*b* at the same time, and a tension applying mechanism 15 for applying tension to the second sheet material T2.

Figure 4:
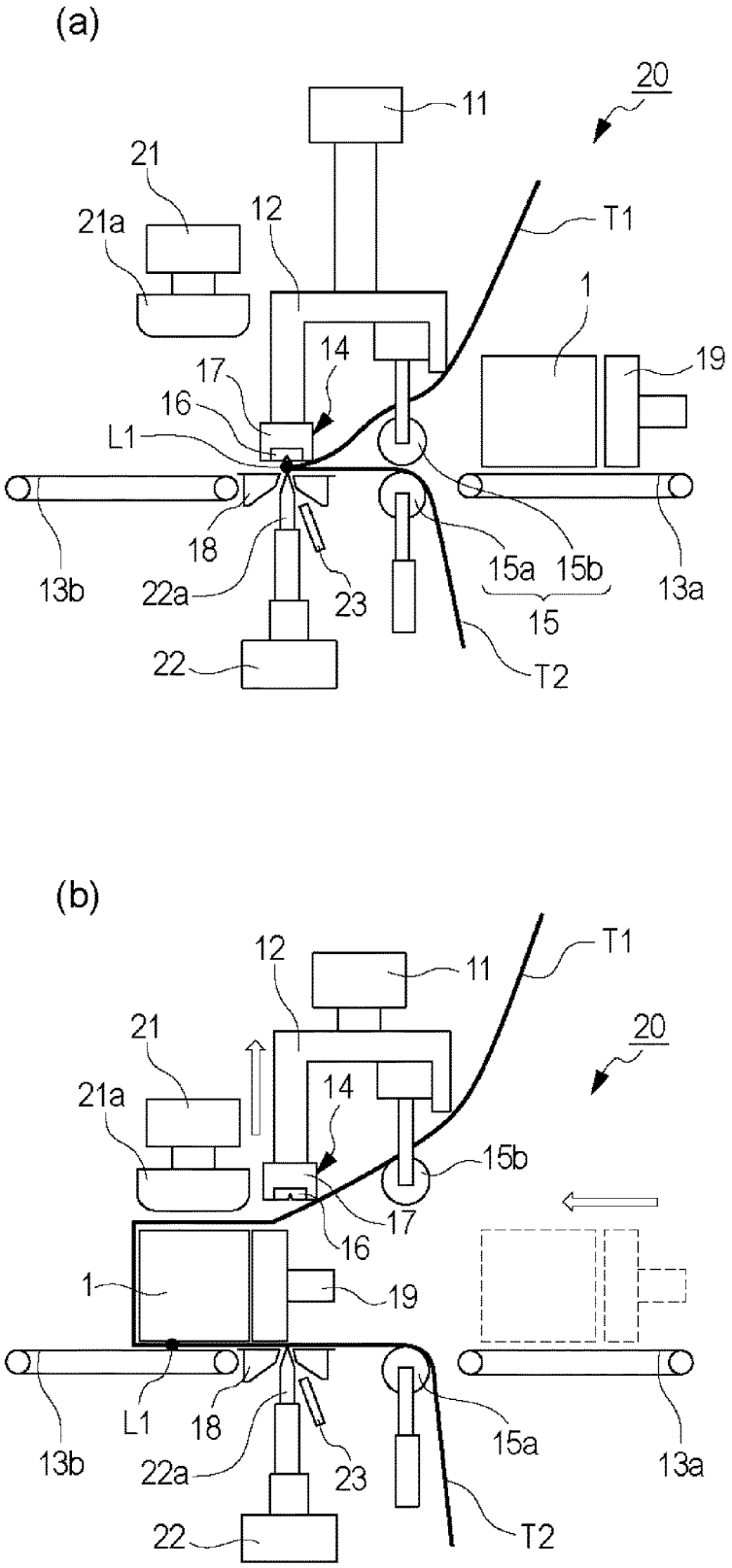
In FIG. 4, (a) and (b) are schematic views for illustrating a sheet wrapping step S2 in a packing method (manufacturing method) in Embodiment 1.

As shown in (a) of FIG. 4, belt conveyers 13 (13*a*, 13*b*) for conveying the box 1 which is the member-to-be-packed are provided in an upstream side and a downstream side, respectively, of the sheet wrapping and fastening device 20. By the belt conveyer 13*a*, the box 1 in which the cartridge P is accommodated is conveyed to the sheet wrapping and fastening device 20. Before the box 1 is conveyed, in the sheet wrapping and fastening device 20, a constitution in which free end portions of the first sheet material T1 and the second sheet material T2 are welded and bonded to each other at a welding portion L1 is employed.

Then, the box 1 is passed through an inside of the sheet wrapping and fastening device 20. At this time, in addition to a heater portion 16 of the fusion-cutting mechanism 14 and a sheet urging portion 17 provided on the heater portion 16 so as to cover not only a back side of the heater portion 16 but also an upstream side and a downstream side of the heater portion 16, a follower roller 15*b* of the tension applying mechanism 15 is moved upwardly as shown in (b) of FIG. 4, so that the box 1 is capable of being passed through the inside of the sheet wrapping and fastening device 20. Specifically, an arm 12 to which the heater portion 16 and the sheet urging portion 17 of the fusion-cutting mechanism 14 and the follower roller 15*b* of the tension applying mechanism 15 are fixed is moved upwardly by a retracting mechanism 11. Thereafter, the box 1 in which the cartridge P is accommodated is pushed by an inserting mechanism 19, so that the box 1 is slid to a predetermined position where the arm 12 is capable of being lowered. Thus, the first display portion 2*e* of the first sheet 2*a* is positioned on an end surface of the box 1 with respect to one widthwise direction, i.e., on a surface extending along the longitudinal direction.

Figure 5:
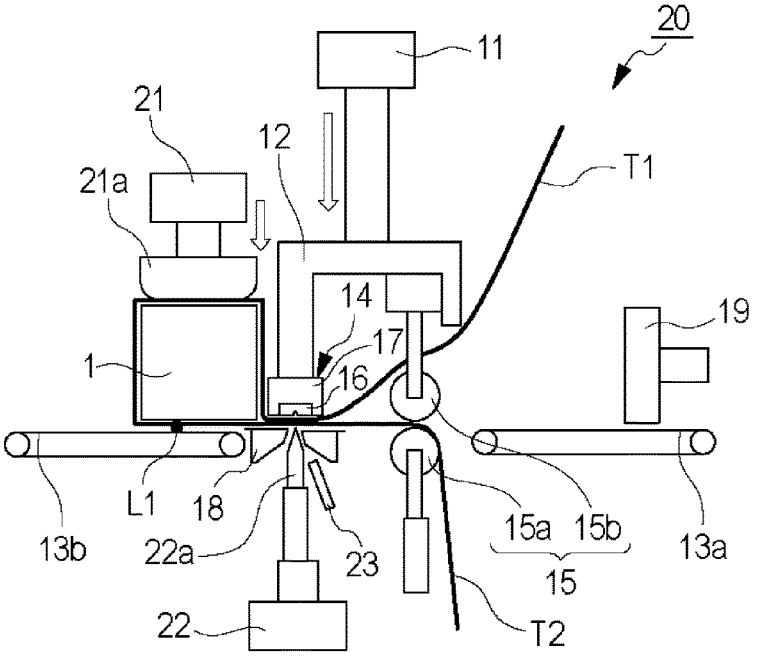
In FIG. 5, (a) and (b) are schematic views for illustrating the sheet wrapping step S2 in the packing method in Embodiment 1.
Figure 5:
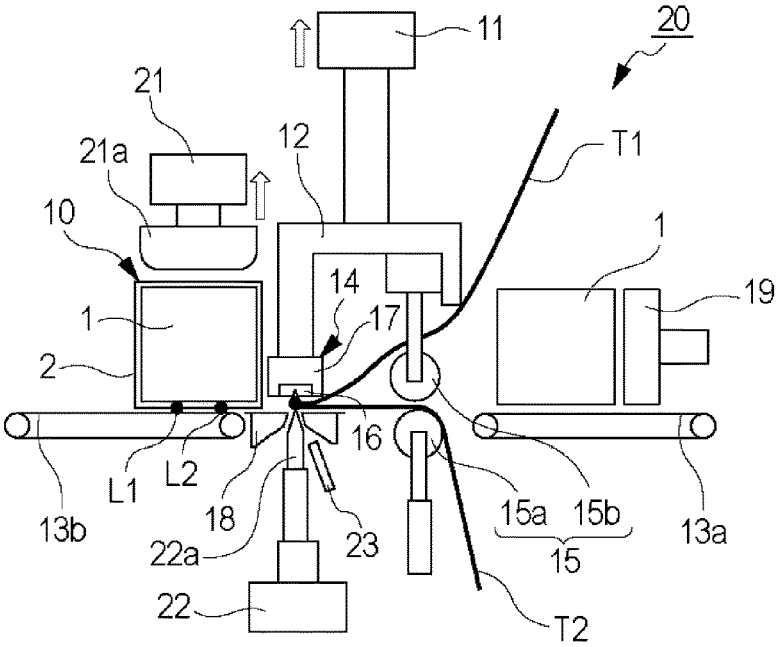

Then, as shown in (a) of FIG. 5, the arm 12 is lowered. As a result, not only the first sheet material T1 and the second sheet material T2 are sandwiched between the sheet urging portion 17 and a sheet supporting portion 18 of the fusion-cutting mechanism 14, but also the second sheet material T2 is sandwiched between a tension applying roller 15*a* and the follower roller 15*b* of the tension applying mechanism 15.

At this time, a constitution in which the first sheet material T1 is pulled out in a predetermined amount when the box 1 is slid to a predetermined position by the above-described inserting mechanism 19, for example, in which the first sheet material T1 is pulled out in a predetermined length is employed. Or, a cutting position is detected by a design such as a mark or the like of the first sheet material T1, and thus the first sheet material T1 is made cuttable at a specific portion. In this manner, in the case where the sheet material T1 is provided with the transparent portion 2*c*, a positional deviation of the transparent portion 2*c* from the second display portion 1*a* of the box 1 is suppressed, so that the transparent portion 2*c* is superposed on the second display portion 1*a*. Further, in this embodiment, the length of the first sheet material T1 was adjusted, so that the welding portion L1 was positioned at the bottom of the box 1. Incidentally, in the case where a design detecting portion (not shown) for detecting the mark or the like of the first sheet material T1 is provided, it is preferable that the design detecting portion is provided downstream of the fusion-cutting mechanism 14 for the purpose of enhancing positional accuracy.

After the specific portion of the first sheet material T1 is disposed so as to be cuttable by the fusion-cutting mechanism 14, in this embodiment, the box 1 is fixed by a fixing mechanism 21. Specifically, the box 1 is sandwiched between a fixing portion 21*a* of the fixing mechanism 21 and the sheet supporting portion 18 and between the fixing portion 21*a* of the fixing mechanism 21 and the belt conveyer 13*b*.

After the box 1 is fixed by the fixing mechanism 21, the tension applying mechanism 15 is driven, so that predetermined tension is applied to the second sheet material T2. Specifically, the box 1 is fixed by the fixing mechanism 21, and as the second sheet material T2, a sheet material having elasticity is used. More specifically, the second sheet material T2 is higher in degree of the elasticity than the first sheet material T1. For this reason, the first sheet material T1 is not moved by friction with the box 1, particularly with a corner of the box 1, and the second sheet material T2 is in an elongated state.

Thus, in a state in which the box 1 is fixed in a state in which the specific portion of the first sheet material T1 is cuttable between the sheet urging portion 17 and the sheet supporting portion 18 and in which the second sheet material T2 is elongated, a cutting mechanism 22 is driven, so that the first sheet material T1 and the second sheet material T2 are cut by a cutter 22*a* of the cutting mechanism 22. Specifically, the cutter 22*a* is engaged with a groove provided on the heater portion 16. As a result, the cutter 22*a* cuts the first sheet material T1 and the second sheet material T2 and at the same time, end surfaces of the first sheet material T1 and the second sheet material T2 which are cut are welded and bonded to each other, so that a second welding portion L2 is formed. As a result, it is possible to provide a constitution in which the box 1 is covered with a ring member constituted by the first sheet material T1 and the second sheet material T2. After the first sheet material T1 and the second sheet material T2 are welded at their end surfaces, a cut portion cooling device 23 cools and solidify the second welding portion L2 between the first sheet material T1 and the second sheet material T2.

Then, as shown in (b) of FIG. 5, the arm 12 to which the heater portion 16 and the sheet urging portion 17 of the fusion-cutting mechanism 14 and the follower roller 15*b* of the tension applying mechanism 15 are fixed is moved upwardly by the retracting mechanism 11. As a result, the first sheet material T1 and the second sheet material T2 sandwiched between the sheet urging portion 17 and the sheet supporting portion 18 are released, so that the ring member constituted by the first sheet material T1 and the second sheet material T2 is closely contacted to the box 1 by a contracting force of the second sheet material T2. Thus, the ring member consisting of the first sheet 2*a* formed of the first sheet material T1 and the second sheet 2*b* formed of the second sheet material T2 can be wrapped and fastened to the box 1.

Figure 6:
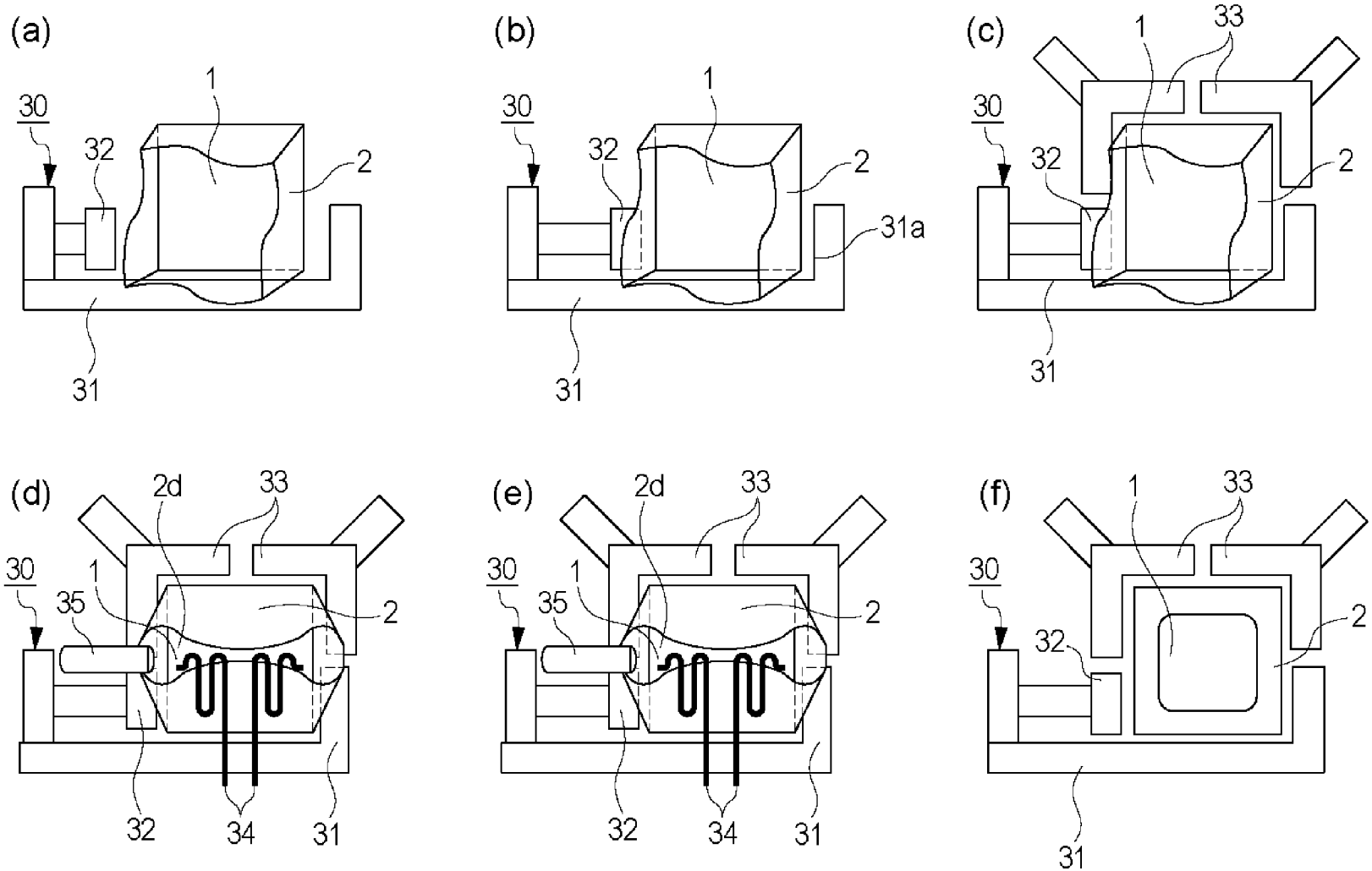
In FIG. 6, (a) to (f) are schematic views for illustrating a shrink step S3 in the packing method in Embodiment 1.

Although the first sheet 2*a* and the second sheet 2*b* which are wrapped and fastened to the box 1 are closely contacted to box 1 by the contracting force of the second sheet 2*b*, the box 1 is in a state in which the box 1 is capable of disconnecting and dropping from the ring member formed with the first sheet 2*a* and the second sheet 2*b*. Therefore, in order to prevent the disconnection and the drop of the box 1, using a shrinking device 30, a shrinking step S3 for thermally shrinking the sheet member 2 (first sheet 2*a*) is performed. In FIG. 6, (a) to (f) are schematic views for illustrating a procedure of the shrinking step S3 by the shrinking device 30.

The shrinking device 30 includes a tray 31 on which the box 1 which is the member-to-be-packed is mounted, a positioning mechanism 32, contraction preventing mechanisms 33, a supporting member 34 and a heating means 35. As shown in (a) of FIG. 6, the box 1 wrapped (packed) and fastened by the sheet member 2 is conveyed and mounted onto the tray 31 by an unshown conveying device. Then, as shown in (b) of FIG. 6, the box 1 is slid on the tray 31 by the positioning mechanism 32 and is pressed against a positioning surface 31*a* provided on the tray 31, so that positioning of the box 1 relative to the shrinking device 30 is made. Thereafter, the contraction preventing mechanism 33 is moved toward upper two corners of the box 1 ((c) of FIG. 6, (a) of FIG. 7). At this time, the contraction preventing mechanism 33 is disposed in contact with the box 1 or with an interval of about 1-10 mm from the box 1 in the neighborhood of an end surface of the box 1 crossing the longitudinal direction of the box 1 subjected to a shrinking process. In order to prevent damage of the box 1, the contraction preventing mechanism 33 may preferably be disposed with the interval of about 1-10 mm from the box 1. Therefore, in this embodiment, the contraction preventing mechanism 33 was disposed so as to have an interval of about 5 mm from the box 1. Incidentally, as the contraction preventing mechanism 33, one including a cooling mechanism may also be used and one capable of blocking and reducing heated air toward the first display portion 2*e* of the first sheet 2*a* and capable of suppressing heat conduction to the first sheet 2*a* (ring member) is used. Further, the contraction preventing mechanisms 33 are also disposed so as to have an interval of 10 mm or less therebetween, specifically are disposed in contact with each other or with an interval of about 1-10 mm therebetween. Incidentally, the contraction preventing mechanism 33 is heated by the heated air, and therefore, may preferably have a structure capable of dissipating the heat without accumulating the heat or be coolable.

Figure 7:
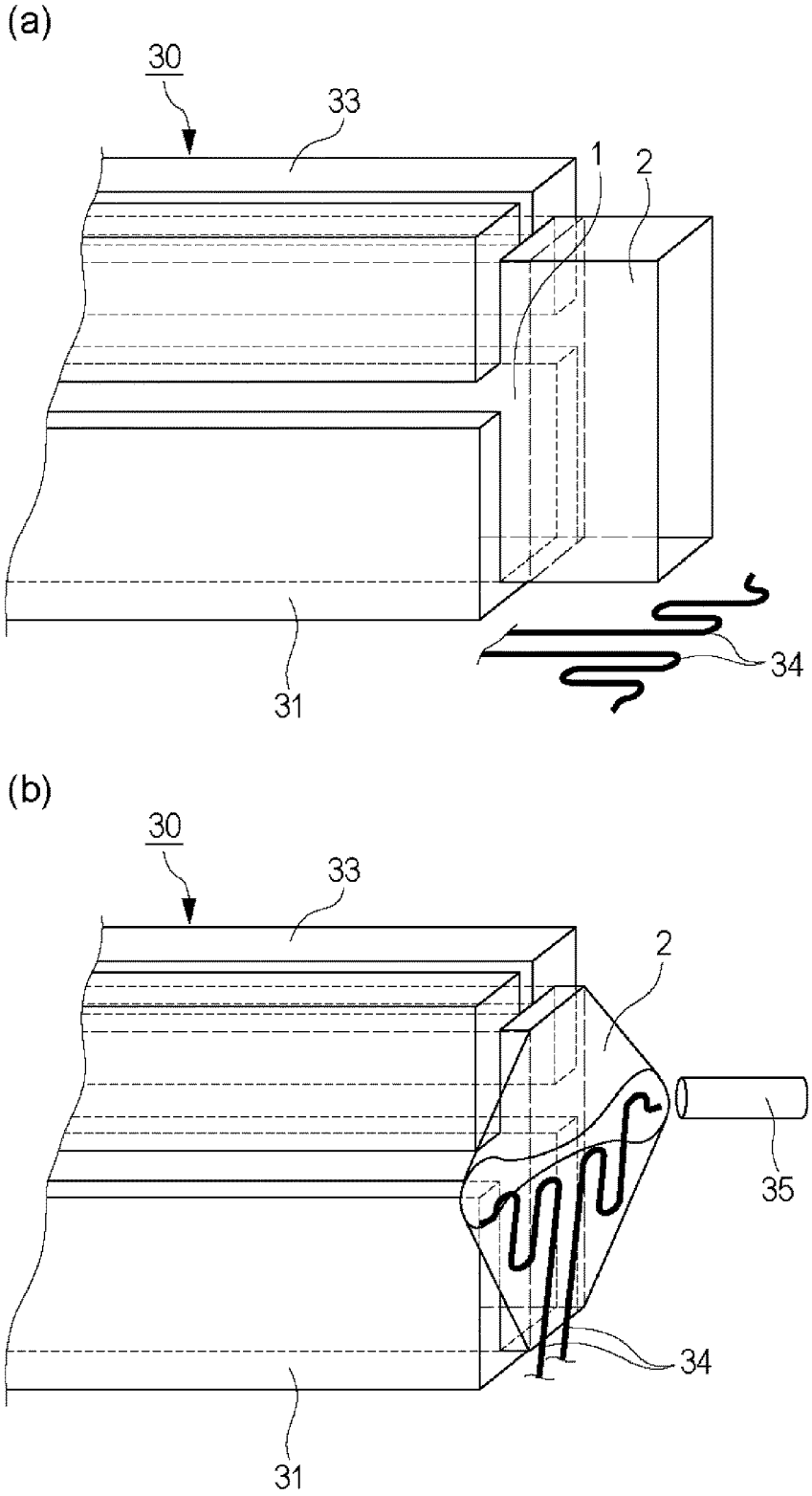
In FIG. 7, (a) and (b) are schematic views for illustrating the shrink step S3 in the packing method in Embodiment 1.

Then, free end portions of the sheet member 2 projected from the end portion of the box 1 are supported by the supporting member 34 ((d) of FIG. 6, (b) of FIG. 7). Specifically, the sheet member 2 extending from a portion thereof contacting the bottom of the box 1 is raised vertically. At this time, the sheet member 2 extending from the portion contacting the bottom of the box 1 is raised so as to have some space between itself and the side surface of the box 1. The sheet member 2 extending from the portion contacting the bottom of the box 1 extends upwardly with respect to the vertical direction by the supporting member 34, and the sheet member 2 extending from a portion thereof contacting the upper surface of the box 1 extends downwardly with respect to the vertical direction by gravitation. As a result, an opening 2*d* having a large length with respect to the vertical direction is formed at either one or both of portions with respect to the horizontal direction.

Then, as shown in (e) of FIG. 6, in a state in which the sheet member 2 is held (supported) by the supporting member 34, the heated air is blown from the heating means 35 onto the sheet member 2, so that the side surface of the box 1 is covered with the sheet member 2 as shown in (f) of FIG. 6. At this time, at first, of the opening 2*d* increased in length with respect to the vertical direction, the heated air is blown into a space surrounded by the sheet member 2, specifically the heated air is directly blown onto the box 1 and thus the sheet member 2 is contracted, and thereafter, the heated air is blown onto an entire side surface of the box 1, so that the sheet member 2 is uniformly contracted. As a result, it is possible to form a packing member capable of preventing disconnection (drop) of the box 1 (structure) without contracting the first display portion 2*e* of the sheet member 2. Incidentally, also during the contraction of the sheet member 2 by the blowing of the heated air, the supporting member 34 is in a state in which the supporting member 34 supports the sheet member 2. For this purpose, in order to satisfactorily support the sheet member 2 by the supporting member 34, the sheet member 34 was formed in a bent shape. Further, also during the contraction of the sheet member 2, the state in which the sheet member 2 is supported by the supporting member 34 is formed, and therefore the supporting member 34 may also be provided with a cooling device. By providing the supporting member 34 with the cooling device, heat accumulation in the supporting member 34 is suppressed, so that it is possible to suppress the contraction of the sheet member 2 by the heat accumulated in the supporting member 34 and thus to suppress non-uniform contraction of the sheet member 2. Therefore, in this embodiment, as shown in (d) of FIG. 6, a tube (pipe)-shaped supporting member 34 was used, so that the supporting member 34 itself was made coolable by passing the air through the tube. Further, as in this embodiment, the air for cooling the supporting member 34 may preferably be discharged from a free end portion of the supporting member 34, so that the opening 2*d* of the sheet member 2 is further opened and the heated air is blown through the opening 2*d* and thus the sheet member 2 is easily contracted.

Effect

In this embodiment, the tension applying mechanism 15 is driven and the predetermined tension is applied to the sheet member 2, so that the second sheet material T2 is placed in the elongated state and then the first sheet material 1 and the second sheet material T2 are cut and welded by the cutter 22*a* of the cutting mechanism 22 and thus the second welding portion L2 is formed. As a result, a contracting force can be generated in the second sheet material T2 having the elasticity, so that the ring member constituted by the first sheet material T1 and the second sheet material T2 can be fastened and closely contacted to the box 1. As a result, it is possible to suppress the elongation and the contraction of the first sheet 2*a*, so that the sheet member 2 can be wrapped and fastened to the box 1 while suppressing disablement of reading of the information due to the loss of the shape of the character, the graphic, the symbol, the code or the like displayed on the first sheet 2*a* at the first display portion 2*e*.

Further, in this embodiment, the constitution in which the first sheet material T1 is pulled in the predetermined amount when the box 1 is slid to the predetermined position by the inserting mechanism 19 or the constitution in which the cutting position is detected by the design of the first sheet material T1 such as the mark and then the first sheet material T1 can be cut at the specific portion is employed. As a result, the positioning between the box 1 and the sheet member 2 can be made, and particularly in the case where the first sheet material T1 is provided with the transparent portion 2*c*, it is possible to suppress the positional deviation of the transparent portion 2*c* from the second display portion 1*a* of the box 1. Further, by adjusting the length of the first sheet material T1, the welded portion L1 can be positioned at the bottom of the box 1, so that the design property can be enhanced.

In addition, in this embodiment, the shrinking step 3 in which the contraction preventing mechanism 33 is disposed in contact with the box 1 or with the interval of about 1-10 mm from the box 1 before the shrinking process and then the sheet member 2 is contracted is performed. By the contraction preventing mechanism 33, it is possible to suppress the blowing of the heated air onto the sheet member 2 at a portion other than the longitudinal end portions of the sheet member 2 or to suppress the contraction of the sheet member at the portion other than the longitudinal end portions by reducing an amount of the heated air blown onto the portion other than the longitudinal portions. As a result, at longitudinal end surfaces of the box 1, the contracted portions 2*d* can be formed as a part of the sheet member 2 so as to surround side surfaces of the box 1 extending along a direction crossing the longitudinal direction, so that it is possible to suppress disconnection of the box 1 from the sheet member 2.

Incidentally, the contraction preventing mechanism 33 is disposed with the interval of about 1-10 mm from the box 1, so that it is possible to prevent damage of the sheet member 2 by the contraction preventing mechanism 33.

Further, in this embodiment, in the state in which the sheet member 2 was supported by the supporting member 34, the heated air was blown from the heating means 35 onto the sheet member 2, so that the side surface of the box 1 was covered with the sheet member 2. At this time, at first, of the opening 2*d* increased in length with respect to the vertical direction, the heated air is blown into the space surrounded by the sheet member 2, specifically is directly blown onto the box 1, so that the sheet member 2 can be finely contracted. Particularly, the sheet member 2 was contracted in the state in which the sheet member 2 extending from the portion contacting the bottom of the box 1 was supported by the supporting member 34. As a result, the portion contacting the side surface of the box 1 and raising upwardly can be formed at the contracted portion 2*d*, so that the disconnection of the box 1 from the sheet member 2 can be suppressed further satisfactorily.

In addition, in this embodiment, a portion where the design property as a product package is further required can be formed as the first display portion 2*e* of the first sheet 2*a* is advance, while the box 1 is covered with the first sheet 2*a*, and therefore, the outer surface of the box 1 is not required to be subjected to a surface protecting process. For this reason, the second display portion la for displaying only the information depending on the cartridge can be formed on the common box 1 by an easy forming method depending on the cartridge before the packing of the cartridge. As a result, even in the case where the packing member depending on the plurality of members-to-be-packed is formed, the common sheet and the common box can be used, so that a storage space for the packing materials can be reduced.

Modified Embodiment 2

In the above-described embodiment, in the sheet wrapping step S2, the box 1 was sandwiched between the fixing portion 21*a* of the fixing mechanism 21 and the sheet supporting portion 18 and between the fixing portion 21*a* of the fixing mechanism 21 and the belt conveyer 13*b* and then was fixed to the sheet wrapping and fastening device 20. However, the present invention is not limited thereto, but it is possible to use a device which does not include the fixing mechanism 21 when the predetermined tension can be applied to the second sheet material T2 by the tension applying mechanism 15 of the sheet wrapping and fastening device 20.

Further, in the above-described embodiment, the tension applying mechanism 15 has the constitution in which the tension applying roller 15*a* and the retractable follower roller 15*b* were provided. However, the present invention is not limited thereto, but may also employ not only, e.g., a constitution in which a retractable tension applying roller 15*a* and a fixed follower roller 15*b* are provided but also another constitution when the constitution is capable of applying the tension to the second sheet material T2.

Further, in the above-described embodiment, the constitution in which the single box 1 was wrapped with the sheet member 2, but the present invention is not limited thereto. For example, in the case where a plurality of boxes 1 are integrally wrapped with the sheet member 2, in the sheet wrapping step S2, the plurality of boxes 1 may only be required to be disposed in the sheet wrapping and fastening device 20 and then be integrally wrapped with the sheet member 2. Other steps can be performed similarly as in the above-described embodiment.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

INDUSTRIAL APPLICABILITY

According to the present invention, it is possible to provide a packing member and a packing method which are capable of suppressing loss of a shape of information displayed on a sheet at a display portion to facilitate reading of the displayed information.

The invention claimed is:

1. A packing member comprising:

a cartridge for use with an image forming apparatus;

a structure accommodating the cartridge, the structure including a first surface extending along a first direction, a second surface extending along the first direction, and an end surface extending along a direction crossing the first direction; and a cylindrical sheet for wrapping the structure, the cylindrical sheet including (i) a first sheet having a heat contraction property and (ii) a second sheet having an elasticity, the first sheet having a display portion on which information related to the cartridge is printed, the second sheet being shorter than the first sheet with respect to a circumferential direction of the cylindrical sheet, the second sheet being connected with the first sheet in a state in which the second sheet is elongated, and the first sheet being pulled by the second sheet such that the structure is tightened by the first sheet and the second sheet, wherein the display portion is positioned on the first surface and the second sheet is positioned on the second surface, and wherein end portions of the first sheet and the second sheet are contracted so as to cover at least part of the end surface.

2. A packing member according to claim 1, wherein the second sheet has a heat contraction property, and wherein the cylindrical sheet is contracted such that a contraction amount in the display portion is smaller than a contraction amount in the end portions of the first sheet and the second sheet.

3. A packing member according to claim 1, wherein the structure includes a second display portion at an outer surface thereof, and wherein the cylindrical sheet partly includes a transparent portion through which the second display portion is visible.

4. A packing member according to claim 1, wherein the structure includes a plurality of members-to-be-packed, the plurality of members-to-be-packed is integrally wrapped by the cylindrical sheet.

5. A packing member according to claim 4, wherein the plurality of members-to-be-packed includes a first box accommodating a first cartridge, and a second box accommodating a second cartridge, wherein the information printed in the display portion of the first sheet is related to the first cartridge and the second cartridge, and the information printed in the display portion is common to the first cartridge and the second cartridge.

6. A packing member according to claim 1, wherein the first sheet contacts a corner portion of the structure.

7. A packing method of a structure accommodating a cartridge for use with an image forming apparatus by a cylindrical sheet for wrapping the structure, the structure including a first surface extending along a first direction and an end surface extending along a direction crossing the first direction, the cylindrical sheet including (i) a first sheet including a display portion on which information related to the cartridge is printed and having a heat contraction property and (ii) a second sheet having an elasticity and being shorter than the first sheet with respect to a circumference direction of the cylindrical sheet, the packing method comprising:

a first step of bonding the first sheet and the second sheet to each other;

a second step of forming the cylindrical sheet by bonding the first sheet and the second sheet in a state in which (i) the display portion is positioned on the first surface, (ii) tension is caused to act on the second sheet, and (iii) the second sheet is elongated; and a third step of contracting end portions of the first sheet and the second sheet so as to cover at least part of the end surface.

8. A packing method according to claim 7, further comprising a fourth step of forming a second display portion at an outer surface of the structure, wherein as the first sheet, a sheet partly including a transparent portion is used, and in the first step, the first sheet is disposed so that the second display portion of the structure is visible through the transparent portion.

9. A packing method according to claim 7, wherein the second sheet has a heat contraction property, and wherein the cylindrical sheet is contracted such that a contraction amount in the display portion is smaller than a contraction amount in the end portions of the first sheet and the second sheet.

10. A packing method according to claim 7, wherein the structure includes a plurality of members-to-be-packed, the plurality of members-to-be-packed is integrally wrapped by the cylindrical sheet.

11. A packing method according to claim 7, wherein in the second step, the second sheet is elongated in a state in which movement of the first sheet relative to the structure is restricted.

12. A packing method according to claim 7, wherein the structure includes a second surface extending along the first direction, and wherein the second sheet is positioned on the second surface.

13. A packing method of a structure accommodating a cartridge for use with an image forming apparatus by a cylindrical sheet for wrapping the structure, the structure including a surface extending along a first direction of the structure and an end surface extending along a direction crossing to the first direction, the cylindrical sheet including a display portion on which information related to the cartridge is printed and having a heat contraction property, the packing method comprising:

a first step of providing the structure in the cylindrical sheet so that the display portion is positioned on the surface extending along the first direction;

a second step of raising a first portion of the cylindrical sheet, extending in the first direction from a second portion contacting a bottom of the structure, upwardly with respect to a vertical direction such that the first portion overlaps the end surface when viewed in a direction orthogonal to the end surface, and a third step of contracting the cylindrical sheet by heating means so as to cover at least part of the end surface in a state in which the first portion is raised, wherein the second step is started before the third step is started.

14. A packing method according to claim 13, wherein in the third step, a contraction preventing mechanism for suppressing heat conduction to the display portion is provided in a neighborhood of the end surface.

15. A packing method according to claim 14, wherein in the third step, the structure, the cylindrical sheet and the contraction preventing mechanism are disposed in the listed order with respect to the direction crossing the first direction.

16. A packing method according to claim 15, wherein the contraction preventing mechanism is disposed with an interval relative to the cylindrical sheet.

17. A packing method according to claim 13, wherein the cylindrical sheet includes a first sheet having the display portion and a heat contraction property and a second sheet having an elasticity.

18. A packing method according to claim 17, further comprising a third step of forming a second display portion at an outer surface of the structure, wherein as the first sheet, a sheet partly including a transparent portion is used, and in the first step, the first sheet is disposed so that the second display portion is visible through the transparent portion.

19. A packing method according to claim 17, wherein the second sheet has a heat contraction property, and wherein in the third step, end portions of the first sheet and the second sheet are thermally contracted so as to cover at least part of the end surface.

20. A packing method according to claim 13, wherein the structure includes a plurality of members-to-be-packed, the plurality of members-to-be-packed is integrally wrapped by the cylindrical sheet.

* * * * *